US008869534B2

(12) United States Patent
Böttcher et al.

(10) Patent No.: US 8,869,534 B2
(45) Date of Patent: Oct. 28, 2014

(54) BURNER FOR A GAS TURBINE

(75) Inventors: Andreas Böttcher, Ratingen (DE); Thomas Grieb, Krefeld (DE); Jens Kleinfeld, Mülheim an der Ruhr (DE); Tobias Krieger, Duisburg (DE); Sabine Tüschen, Oberhausen (DE); Ulrich Wörz, Mülheim Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 1529 days.

(21) Appl. No.: 12/520,134

(22) PCT Filed: Dec. 20, 2007

(86) PCT No.: PCT/EP2007/064338

§ 371 (c)(1), (2), (4) Date: Mar. 15, 2010

(87) PCT Pub. No.: WO2008/077882

PCT Pub. Date: Jul. 3, 2008

(65) Prior Publication Data

US 2010/0170267 A1 Jul. 8, 2010

(30) Foreign Application Priority Data

Dec. 22, 2006 (EP) ..... 06026685

(51) Int. Cl.

| | |
|---|---|
| ***F02C 1/00*** | (2006.01) |
| ***F02G 3/00*** | (2006.01) |
| ***F23D 11/36*** | (2006.01) |
| ***F23R 3/28*** | (2006.01) |

(52) U.S. Cl.

CPC ..... *F23R 3/283* (2013.01); *F23D 11/36* (2013.01)

USPC ..... 60/740; 60/737; 60/742; 60/748

(58) Field of Classification Search

USPC ..... 60/737–748

See application file for complete search history.

(56) References Cited

U.S. PATENT DOCUMENTS

| | | | | |
|---|---|---|---|---|
| 3,685,741 | A * | 8/1972 | O'Sickey | 239/406 |
| 4,708,293 | A * | 11/1987 | Graziadio et al. | 239/427 |
| 4,898,329 | A | 2/1990 | Davis | |
| 5,101,634 | A * | 4/1992 | Batakis et al. | 60/737 |

(Continued)

FOREIGN PATENT DOCUMENTS

| | | | |
|---|---|---|---|
| EP | 1167882 | A1 | 1/2002 |
| JP | 09145058 | A | 6/1997 |
| WO | 9919670 | A2 | 4/1999 |
| WO | WO 2004055439 | A1 | 7/2004 |

OTHER PUBLICATIONS

Communication from Ymaguchi International Patent Office, Aug. 8, 2011, pp. 1-21-7.

*Primary Examiner* — Craig Kim

(57) ABSTRACT

A burner for a gas turbine including a main burner and a pilot burner is provided. The main burner has a supporting structure, a heat shield and a holder for the heat shield, and wherein the holder is at least partially located within the supporting structure and the heat shield is at least partially located within the holder. The heat shield is fastened to the holder by a force-fit and/or a frictional connection.

18 Claims, 3 Drawing Sheets

(56) References Cited

U.S. PATENT DOCUMENTS

| | | | | | |
|---|---|---|---|---|---|
| 5,511,725 | A | | 4/1996 | Barker | |
| 5,598,696 | A | * | 2/1997 | Stotts | 60/779 |
| 5,697,553 | A | * | 12/1997 | Stotts | 239/8 |
| 6,038,861 | A | | 3/2000 | Amos | |
| 7,513,098 | B2 | * | 4/2009 | Ohri et al. | 60/39.11 |
| 8,141,363 | B2 | * | 3/2012 | Khan et al. | 60/740 |
| 2003/0014976 | A1 | * | 1/2003 | Mandai et al. | 60/737 |
| 2003/0167771 | A1 | * | 9/2003 | Hayashi et al. | 60/737 |
| 2004/0139750 | A1 | * | 7/2004 | Bretz | 60/776 |
| 2006/0026966 | A1 | | 2/2006 | Moraes | |

* cited by examiner

BURNER FOR A GAS TURBINE

CROSS REFERENCE TO RELATED APPLICATIONS

This application is the US National Stage of International Application No. PCT/EP2007/064338, filed Dec. 20, 2007 and claims the benefit thereof. The International Application claims the benefits of European Patent Office application No. 06026685.5 EP filed Dec. 22, 2006, both of the applications are incorporated by reference herein in their entirety.

FIELD OF INVENTION

The invention relates to a burner for a gas turbine, comprising a main burner and a pilot burner.

BACKGROUND OF INVENTION

As is known from U.S. Pat. No. 6,038,861 for example, gas turbines comprise a compressor for compressing air, a combustor for producing a hot gas by burning fuel in the presence of the compressed air produced by the compressor, and a turbine for expanding the hot gas produced by the combustor. Gas turbines are known to emit undesirable oxides of nitrogen ($NO_x$) and carbon monoxide (CO). Two-stage combustion systems have been developed that simultaneously provide efficient combustion and reduced $NO_x$ emissions. In a two-stage combustion system of said kind, diffusion combustion is performed at the first stage for obtaining ignition and flame stability. Premixed combustion is performed at the second stage in order to reduce $NO_x$ emissions.

The first stage, referred to as the "pilot" stage, is normally implemented by means of a diffusion-type burner and causes significant increases in $NO_x$ emissions.

The main burner is arranged around the pilot burner. The main burner comprises a plurality of main fuel mixers, each having a swirler which generates turbulence in the airstream. Located in the center of the swirler is the fuel supply line which introduces the gas into the airstream.

FIG. 1 shows a fuel supply line with a heat shield in a main burner according to the prior art. The fuel supply line 16 is situated in the interior of a supporting structure 6 which is arranged in the center of the swirler 4. Fuel supply lines 16 which introduce the fuel from the interior of the supporting structure 6 into the swirler vanes 4 are located in the supporting structure 6. Upon exiting from the swirler vanes 4, the gas mixes with the compressed air.

Also situated in the interior of the supporting structure 6 is a holder 8 which conducts the fuel further to the tip 10 of the arrangement. Located inside the holder 8 is a heat shield 18 which insulates the fuel from the environment. Oil injection holes 19 are positioned at the end of the heat shield 18.

The heat shield 18 serves for thermally decoupling the supporting structure 6 of the swirler 4 from the oil ducts 16 in the interior of the arrangement. The heat shield consists of a tube which in the prior art was soldered or welded 12 into the supporting structure 6. The materially bonded connection points 12 prevent the deformation of the supporting structure 6 due to the colder heat shield 18, with the result that thermal stresses can be produced. Because of said potential stresses the maximally possible number of starts—and consequently also the maximum possible useful life—cannot be realized.

Problem Addressed by the Invention

The invention addresses the problem of providing a burner for a gas turbine in which the occurrence of thermal stresses between the supporting structure and the heat shield is reduced.

Solution According to the Invention

The solution to the problem is achieved by means of a burner having the features of the claims. The dependent claims contain advantageous developments of the invention.

According to the invention, the solution to the problem consists in a burner for a gas turbine, the burner comprising a main burner and a pilot burner. The main burner comprises a supporting structure, a heat shield and a holder for the heat shield. The holder is located at least partially inside the supporting structure, in particular concentrically inside the supporting structure, and the heat shield is located at least partially inside the holder, in particular concentrically inside the holder. The heat shield is secured to the holder by means of a force-fit and/or frictional connection.

The force-fit and/or frictional connection results in the holder being thermally decoupled from the oil ducts ($T_{Oil}$=25° C., heat transfer coefficient>5000 W/M$^2$K) in the interior of the heat shield. The thermal stresses between the holder and the heat shield are therefore lower than in the case of the soldered or welded connection according to the prior art. This permits a higher number of starts and as a result enables the components to provide a longer service life. More reliable operation is also assured. Furthermore, the holder is likewise secured to the supporting structure by means of a force-fit or frictional connection. As a result the supporting structure is thermally decoupled from the holder. Lower thermal stresses are produced between the supporting structure and the holder than in the case of the soldered or welded connection. Furthermore, the useful life of the components is increased, thereby resulting in a higher number of starts for the gas turbine.

In a further advantageous development of the invention, the force-fit and/or frictional connection is a clamp connection. In other words, the heat shield is secured by means of a clamp fit between the tip and the holder. The clamp fit permits free thermal expansion, with the result that the stresses in the component can be substantially reduced. The required number of starts can therefore be achieved. Furthermore, the solution is more cost-effective in comparison with the soldered connection (prior art), which requires high precision. In addition or alternatively, the heat shield can also be secured to the holder by means of a screwed connection.

The heat shield can additionally have a collar which serves for more effectively and fixedly clamping the heat shield. The collar can additionally have an external thread and the holder a corresponding internal thread, which interact when the heat shield is fixed to the holder by means of the screwed connection.

The tip is preferably joined to the holder by means of a screwed connection. The screwed connection is a simple construction by means of which the tip can be connected to the holder.

In particular the tip can be crimped to the holder. Crimping offers protection against uncontrolled detachment during the operation of the gas turbine.

In a further advantageous development of the invention, the heat shield is embodied in a tubular shape. This means that the oil duct in the interior of the heat shield is thermally insulated over its entire length.

The burner can additionally have a swirler in the center of which the supporting structure can be arranged.

Furthermore, a gas turbine having a burner as claimed in one of the preceding claims is used.

BRIEF DESCRIPTION OF THE DRAWINGS

Further features, characteristics and advantages of the invention will emerge from the following description of exemplary embodiments with reference to the attached figures, in which.

DETAILED DESCRIPTION OF THE EXEMPLARY EMBODIMENT

Figure 1:
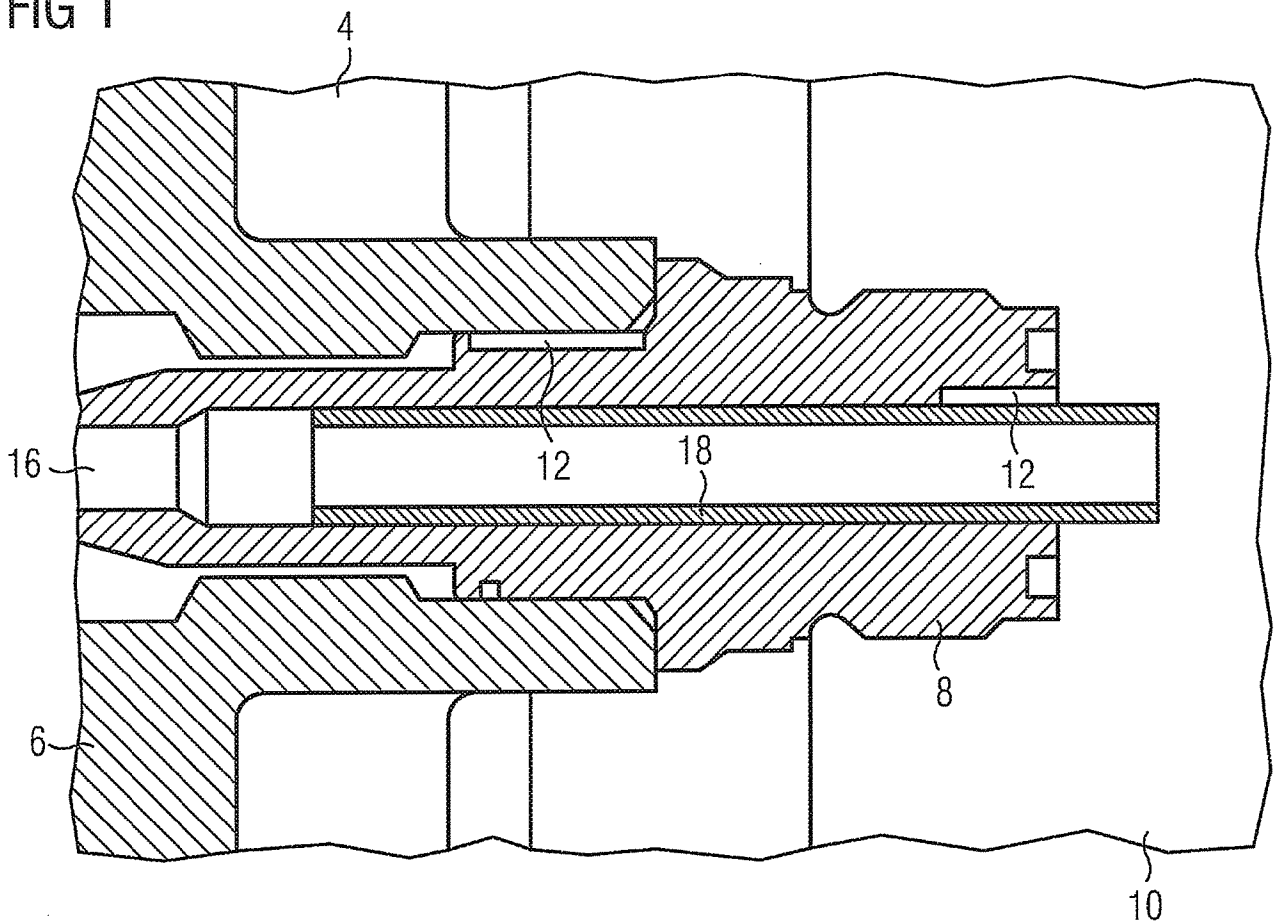
FIG. 1 shows a main burner having a swirler according to the prior art.
Figure 2:
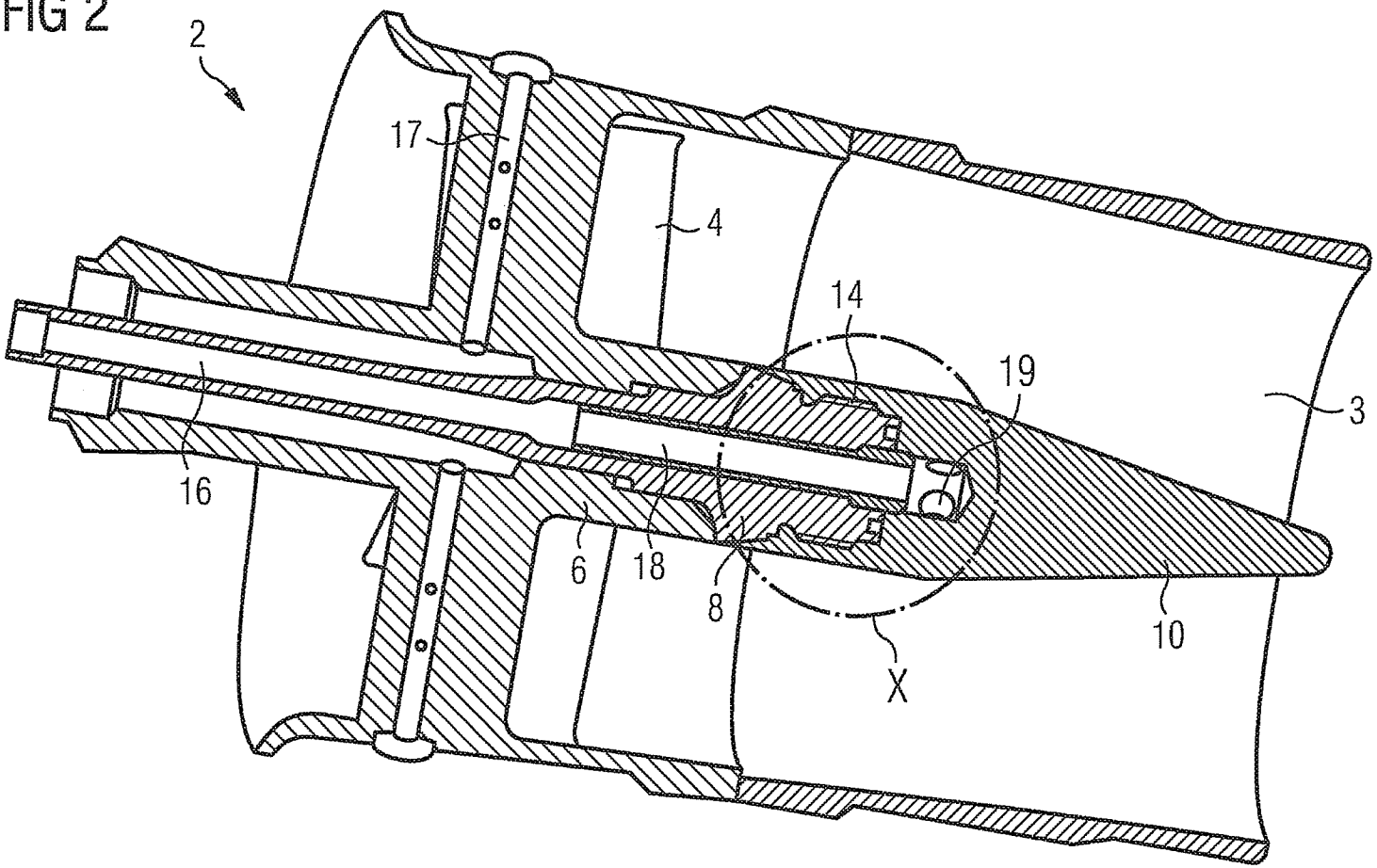
FIG. 2 shows a main burner having a swirler and a heat shield according to the invention.

FIG. 2 shows a main burner 2 comprising a swirler 4, a supporting structure 6, a holder 8, a tip 10, an oil duct 16, swirler channels 17 and a heat shield 18.

The supporting structure 6 is located in the center of the swirler 4. It is implemented in a tubular shape and projects with its two ends beyond the swirler in each case. The holder 8 is also essentially tube-shaped and is located in the interior of the supporting structure 6, concentrically in relation to the swirler 4. The interior of the holder 8 is formed by an oil duct 16 which runs along the longitudinal axis of the holder 8.

The heat shield 18 is arranged in the downstream part of the holder 8. The heat shield 18 adjoins the oil duct 16 and projects beyond the holder 8. The heat shield is likewise tube-shaped and at its downstream-directed end has holes 19 through which the oil that is introduced through the oil duct 16 and routed through the interior of the heat shield 18 and through the tip 10 exits into the combustion chamber 3.

The tip 10 has a conical and a cylindrical part. The cylindrical part is fixed to the holder 8 by means of a screwed connection. In order to protect the tip 10 from becoming detached unintentionally, this part of the tip is crimped. The tip 10 can also be fixed to the holder 8 by crimping alone. Located at the transition between the cylindrical part and the conical part of the tip are oil exit holes through which the oil ducted in the heat shield can exit into the combustion chamber 3.

During operation, air is introduced into the swirler of the main burner 2 by the compressor (not shown). The swirler turbulates the air and the oil exiting from the swirler vanes through the oil channels 17 is mixed with the supplied air. Oil is also ducted through the oil duct 16, routed through the interior of the heat shield and supplied to the combustion chamber 3 of the main burner 2 through the holes 19 in the heat shield and the passages in the tip.

Figure 3:
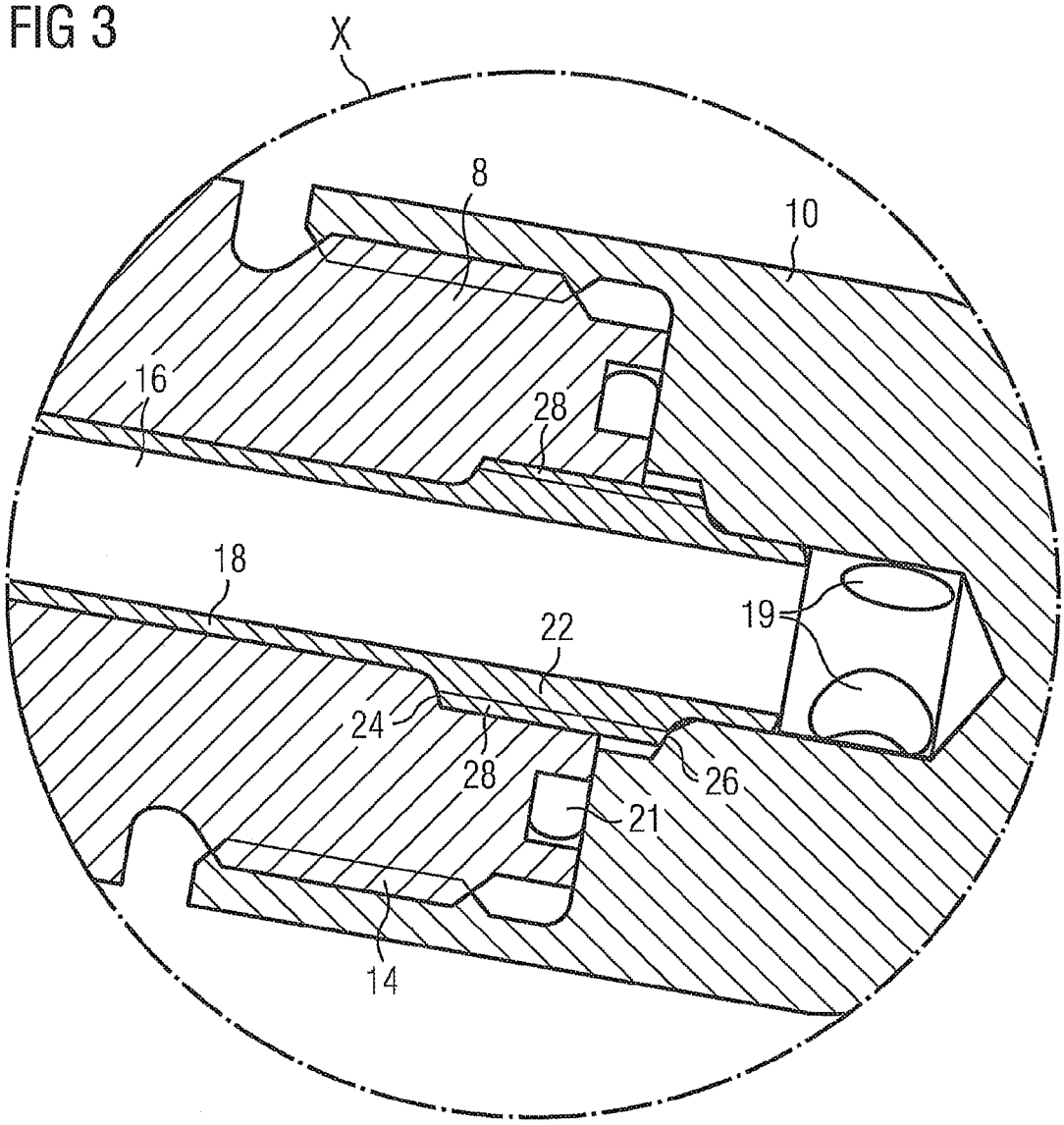
FIG. 3 shows an enlarged detail view of the fixing of the heat shield.

FIG. 3 shows a detail view X of the heat shield arrangement in FIG. 2. The heat shield 18 has a collar 22 having two clamping points 20 and an external thread 28. The clamping points 20 are clamped between a shoulder 24 of the holder and a shoulder 26 of the tip. In addition the heat shield 18 is screwed by means of its external thread 28 into an internal thread of the holder 8. Although the heat shield 18 in the present exemplary embodiment is both clamped between the holder 8 and the tip 10 and secured to the holder by means of a screwed connection, it is basically also possible to fix it solely by clamping or solely by means of a screwed connection.

Located between the holder 8 and the tip 10 is a seal 21. Also clearly recognizable in the detail view is the thread 14 with the aid of which the tip 10 is screwed onto the holder 8.

During operation, the clamping points 20 between heat shield, holder and tip allow free thermal expansion of the holder 8 and the tip 10 around the heat shield 18, which, owing to the material of which it is made (ceramic), barely expands. The metallic components 8 and 10, however, exhibit a relatively high thermal expansion during operation.

The invention claimed is:

1. A burner for a gas turbine, comprising:

a main burner, comprising:

a supporting structure, a heat shield, and a holder for the heat shield; and a pilot burner, wherein the holder is located at least partially inside the supporting structure and the heat shield is located at least partially inside the holder, wherein the heat shield is secured to the holder using a first force-fit and/or a frictional connection, wherein the holder is secured to the supporting structure using a second force-fit and/or a frictional connection, wherein the burner has a tip adjoining the supporting structure, the holder, and the heat shield, and wherein the heat shield contacts the tip and the holder and is secured between the tip and the holder using a third force-fit.

2. The burner as claimed in claim 1, wherein the holder is located concentrically inside the supporting structure.

3. The burner as claimed in claim 1, wherein the heat shield is located concentrically inside the supporting structure.

4. The burner as claimed in claim 1, wherein the heat shield is fixed to the holder using a screwed connection.

5. The burner as claimed in claim 4, wherein the heat shield has a collar.

6. The burner as claimed in claim 5, wherein the collar has an external thread and the holder has a corresponding internal thread.

7. The burner as claimed in claim 4, wherein the tip is fixed to the holder using a screwed connection.

8. The burner as claimed in claim 1, wherein the tip is crimped to the holder.

9. The burner as claimed in claim 1, the heat shield is tube-shaped.

10. The burner as claimed in claim 1, further comprising a swirler and wherein the supporting structure is arranged in a center of the swirler.

11. The burner as claimed in claim 10, wherein the supporting structure is tube-shaped and two ends of the supporting structure project beyond the swirler.

12. The burner as claimed in claim 1, wherein the holder is essentially tube-shaped.

13. The burner as claimed in claim 1, wherein the tip has a conical part and a cylindrical part.

14. The burner as claimed in claim 1, wherein a seal is located between the holder and the tip.

15. The burner as claimed in claim 1, wherein heat shield is made of a material with a lower coefficient of thermal expansion than the holder and the tip.

16. The burner as claimed in claim 1, wherein the interior of the holder is formed by an oil duct which runs along a longitudinal axis of the holder, and wherein heat shield adjoins the oil duct and is arranged in the downstream part of the holder, projecting beyond the holder.

17. The burner as claimed in claim 1, wherein the main burner is arranged around the pilot burner.

18. A gas turbine, comprising:

a burner, comprising:

a main burner, comprising:

a supporting structure, a heat shield, and a holder for the heat shield, and a pilot burner, wherein the holder is located at least partially inside the supporting structure and the heat shield is located at least partially inside the holder, wherein the heat shield is secured to the holder using a first force-fit and/or a frictional connection, wherein the holder is secured to the supporting structure using a second force-fit and/or a frictional connection, wherein the burner has a tip adjoining the supporting structure, the holder, and the heat shield, and wherein the heat shield contacts the tip and the holder and is secured between the tip and the holder using a third force-fit.

* * * * *